US006981848B1

(12) United States Patent
Cessac

(10) Patent No.: US 6,981,848 B1
(45) **Date of Patent: *Jan. 3, 2006**

(54) METHANOL INJECTION SYSTEM AND METHOD TO PREVENT FREEZING OF A NATURAL GAS PIPELINE

(75) Inventor: Kevin J. Cessac, Houston, TX (US)

(73) Assignee: PGI International, Ltd., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/609,973

(22) Filed: Feb. 29, 1996

(51) Int. Cl.
*F04B 49/02* (2006.01)

(52) U.S. Cl. ..... 417/14; 417/46; 137/13; 137/59

(58) Field of Classification Search ..... 417/12, 417/21, 46, 47, 14; 137/13, 59, 101.21, 101.31
See application file for complete search history.

(56) References Cited

U.S. PATENT DOCUMENTS 2,090,069 A * 8/1937 Richardson et al. ... 137/101.31
3,049,142 A * 8/1962 Oliver ..... 137/101.21
3,381,699 A * 5/1968 Coffman ..... 137/101.21
3,989,574 A * 11/1976 Evans ..... 156/351
4,007,755 A * 2/1977 Lerner et al. ..... 137/101.21
4,525,127 A * 6/1985 Welker ..... 417/479
4,631,967 A * 12/1986 Welker ..... 73/861.25
5,388,905 A * 2/1995 Ake et al. ..... 137/13

FOREIGN PATENT DOCUMENTS

FR 2618210 * 7/1987
JP 55-102018 * 8/1980

OTHER PUBLICATIONS 2 home pages of Welker Engineering downloaded from the World Wide Web on Apr. 28, 1999.*

* cited by examiner

*Primary Examiner*—Timothy S. Thorpe
*Assistant Examiner*—Ehud Gartenberg
(74) *Attorney, Agent, or Firm*—Browning & Bushman P.C.

(57) ABSTRACT

A system for injecting an injection fluid into a pipeline includes an injection pump, a timer for initiating sequencing of the pump, a control valve for controlling the flow of pressurized fluid to power the injection pump, a controller for controlling operation of the control valve, and an electric motor responsive to the controller for rotating a cam on the motor shaft to open and close the control valve. The injected fluid may be methanol, so that the system automatically injects methanol into a pipeline which transmits natural gas. In one embodiment, the system includes a temperature sensor and a flow sensor for inputting signals to the controller.

19 Claims, 1 Drawing Sheet

METHANOL INJECTION SYSTEM AND METHOD TO PREVENT FREEZING OF A NATURAL GAS PIPELINE

FIELD OF THE INVENTION

The present invention relates to systems and techniques for periodically injecting a desired fluid into a pipeline. More particularly, this invention relates to a system for selectively activating and disabling the periodic injection of methanol into a natural gas pipeline in a manner which significantly reduces system power consumption.

BACKGROUND OF THE INVENTION

During winter months, natural gas pipelines need to be protected to avoid freezing. At various locations along the pipeline, the pressurized natural gas passes through meters, orifice plates, or other in-line equipment which causes the natural gas to briefly increase in velocity. At these locations, condensate may form which freezes in cold weather. Stored methanol has long been used as a suitable fluid for injecting into a pipeline to prevent freezing. A small amount of added methanol prevents the formation of ice at these locations, and thus prevents pipeline freezing. A methanol injection pump may be powered by the natural gas pressure to inject a small quantity of methanol at a selected interval, e.g., 10 cc of methanol every 7 seconds, thereby preventing pipeline freezing.

Existing methanol injection systems may be deactivated in the Spring and reactivated in the Fall, since pipeline freezing is not a concern during warm weather. Existing systems undesirably utilize more methanol than required to prevent freezing, however, since an activated system continues to inject methanol even when the ambient temperature would not result in freezing. Since the methanol injection system is typically installed at remote locations which do not have available electric power, the power required to repeatedly activate and deactivate the system is of primary concern. Accordingly, existing systems remain continually on to inject methanol even when the ambient temperature will not result in freezing.

One proposed methanol injection system is the Style MS-1 system from Welker Engineering Co. in Sugar Land, Tex. This system utilizes a flow switch which is coupled to an orifice plate in the pipeline to sense the termination of natural gas flow through the pipeline. The system includes a solenoid powered by a 6-volt battery to control the flow of methanol from a storage tank into the pipeline. If the pipeline differential pressure across an orifice plate drops below a selected value, the solenoid valve activates a 4-way valve actuator, which in turn blocks the flow of methanol to the pipeline since natural gas is not being transmitted through the pipeline. As long as natural gas is flowing through the pipeline and the system is not manually deactivated for the Summer season, the metering pump is periodically activated by a timer to inject a selected quantity of methanol into the pipeline. This proposed system has had little if any commercial acceptance, primarily due to the power consumption of the monitoring system. As long as the monitoring system was activated, electrical power was required to maintain the solenoid valve in its proper position for controlling activation of the injection pump. As a practical matter, the high labor cost involved in continually replacing batteries often did not justify the benefit of saving methanol when flow through the pipeline was terminated.

The disadvantages of the prior art are overcome by the present invention, and an improved system and technique for periodically injecting a desired fluid into a pipeline is hereinafter disclosed. The techniques of the present invention are particularly well suited for controlling the injection of methanol into a natural gas pipeline to prevent freezing of the pipeline.

SUMMARY OF THE INVENTION

A suitable embodiment of the invention comprises a methanol storage tank, an injection pump, a timer for sequentially cycling the injection pump to pass methanol from the storage tank to the pipeline, and a controller for regulating operation of the system. The controller is responsive to a temperature probe which may sense either internal pipeline temperature or ambient temperature, and may also be responsive to natural gas flow through the pipeline. The controller operates a valve to control fluid pressure to the timer, so that the pump is cycled in response to the timer only when the control valve is in the open position.

An activation signal from the controller passes DC power from a battery to activate the control motor. The control motor rotates a cam to open and close the valve, and a switch is responsive to cam rotation to stop rotation of the control motor. A low temperature signal from the temperature probe thus causes the control motor to rotate the cam to a valve open position, and a high temperature signal from the probe causes the control motor to rotate the cam to a valve closed position. A significant advantage of the present invention is the low energy required to sequence the control valve between the opened and a closed positions. Moreover, no energy is required to maintain the valve in either the opened or closed position, so that under normal circumstances the battery only supplies low power to the sensors to monitor temperature.

The techniques of the present invention may also be applied to control injection of an odorant into a natural gas pipeline, or to control activation of an injection pump to add a rust or corrosion inhibitor into a pipeline. In some cases, there is no need to have the controller to be responsive to temperature, and the controller may deactivate the system only in response to a sensed no-flow condition through the pipeline. A motor supplied with DC power from a battery is preferably used to control opening and closing of the control valve. Only a very low power consumption required by the sensor or sensors is normally used, so that the system battery has a long operating life and the injection system may be reliably used at various remote locations.

It is an object of the present invention to provide a system for periodically injecting a desired fluid in a pipeline wherein the system utilizes very low power to regulate a control valve which activates and deactivates the system. It is a related object of the invention to provide an improved system for injecting a selected fluid into a pipeline at a remote location wherein little or no energy is used to maintain the control valve in either a valve opened or valve closed position.

It is a feature of the present invention that the injection system may be used for reliably preventing freezing of a natural gas pipeline while minimizing methanol consumption by deactivating the injection when the sensed temperature rises above a selected high temperature value. It is also a related feature of the invention to utilize a control motor for intermittently supplying power to activate the motor and thereby open or close the control valve. The power consumption of the control motor is low, and the motor utilizes no power to maintain the control valve in either the opened or closed positions.

A significant advantage of the present invention is the relatively low cost of the system for reliably injecting a selected fluid into a pipeline. Since energy consumption is minimal to control operation of the control valve, energy from the battery may be used to reliably monitor various sensors which reliably control operation of the system. When the injection system is used to control the input of methanol into a natural gas pipeline, the controller is responsive to a temperature probe so that the system is deactivated when the temperature rises above a selected value, thereby significantly reducing methanol consumption.

It is another advantage of the present invention that the injection system may be operated in an intrinsically safe manner due to the low consumption of electrical power. The injection system may thus be used in conjunction with a combustible or explosive gas in the pipeline, since low energy consumption does not cause sparking concerns commonly associated with higher energy consumption systems.

These and further objects, features, and advantages of the present invention will become apparent from the following detailed description, wherein reference is made to the figures in the accompanying drawings.

DETAILED DESCRIPTION OF THE PREFERRED EMBODIMENTS

Figure 1:
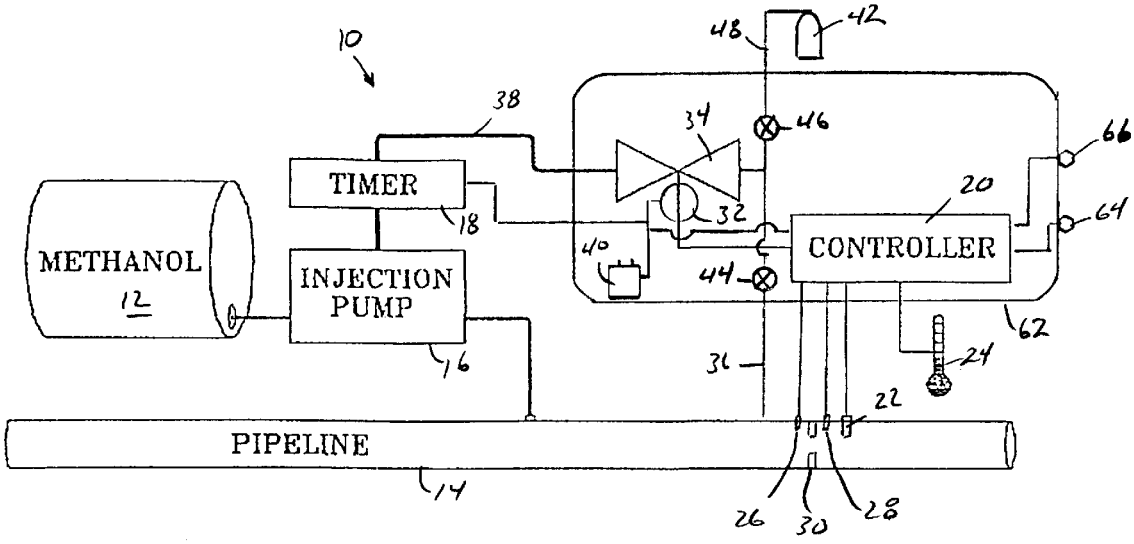
FIG. 1 is a schematic view of a suitable methanal injection system according to the present invention for preventing freezing of a natural gas pipeline.

FIG. 1 illustrates an injection system 10 according to the present invention for periodically inputting methanol from storage tank 12 to a natural gas pipeline 14 to prevent freezing. The system 10 includes an injection pump 16 which is responsive to a selected operator control setting of the timer 18. Electronic controller 20 receives signals from line temperature sensor 22, ambient temperature sensor 24, and/or pressure transducers 26 and 28 positioned on the upstream and downstream sides respectively of flow restriction 30 within the pipeline 14. Those skilled in the art will appreciate that the measured pressure differential from transducers 26 and 28 for a given sized flow restriction corresponds to a predetermined flow rate of natural gas through the pipeline. Accordingly, the controller 20 effectively is able to determine the temperature of the natural gas in the pipeline 14, the ambient temperature exterior of the pipeline, and the flow rate of natural gas through the pipeline.

The controller 20 controls operation of control motor 32, which in turn opens and closes valve 34. Valve 34 receives pressurized natural gas from the pipeline 14 via flow line 36 and, when valve 34 is opened, outputs pressurized natural gas via line 38 to timer 18 and then to injection pump 16 for powering the injection pump through a pumping cycle. The stroke of injection pump 16 may be adjusted for varying the volume of each pumping cycle, so that a selected quantity of methanol, e.g., 10 cc, may be pumped from the storage tank 12 to the pipeline 14 each time the pump is cycled. A suitable injection pump according to the present invention is either the Model NOVA pump sold by PGI International, Ltd., or the Model 250 V pump sold by Williams Instrument Company. Timer 18 may be set by the operator to cycle the pump in a selected time interval of, for example, 7 seconds. The injection pump 16 will thus be activated when pressurized fluid is transmitted through the valve 34 and is available for powering the pump 16. Suitable timers for controlling the injection pump 16 are well known in the art, and a suitable timer is the Model MK-II timer available from Williams Instrument Co. The timer 18, the motor 32, the controller 20, the sensors 22 and 24, and the transducers 26 and 28 may all be powered by a conventional 4.5-volt DC battery 40.

The controller 20 may be responsive to either the temperature sensor 22 or the temperature sensor 24, or the combination of signals from the temperature sensors. Signals from either or both of the sensors 22 and 24 are intended to activate the system 10 and open the control valve 34 any time the temperature falls below a preselected low temperature value which represents a possible freezing condition within the pipeline 14. Controller 20 also deactivates the system 10 any time the sensors indicate that the temperature is above a preselected high temperature value which represents a temperature at which any condensate formed in the pipeline 14 would not freeze. In a typical operation, the controller 20 may activate the system to open the valve 34 when the signal from sensor 22 in the line 14 drops below 30° F., or when the ambient temperature sensed by sensor 24 drops below 28° F. Thus if the ambient temperature briefly drops below freezing but the natural gas within the line 14 is sufficiently warmed so that freezing will not occur, the controller will not open the valve 34. As a safety precaution, however, the valve 34 may be automatically opened to activate the system any time the ambient temperature drops below 28° F. Once the valve 34 is opened, valve 34 may remain opened until the temperature in the pipeline as sensed by sensor 22 rises above 34° F. or when the ambient temperature rises above 38° F. Accordingly, when the day time temperature fluctuates between 40° or 50° F. and the night time temperature fluctuates around freezing, the valve will remained closed and the injection system will be deactivated. When the night time temperature drops below 28° F. or the pipeline temperature drops below 30° F., the valve 34 will be opened and will remain open until the day time temperature raises the signal from one or both of the sensors 22 and 24 above the respective high temperature set value. Accordingly, the valve 34 will not be repeatedly cycled opened and closed as the temperature fluctuates around freezing.

Another embodiment of the invention utilizes a single temperature sensor which may be selectively installed to monitor either the temperature of the fluid in the pipeline or the ambient temperature at the location of the injection system. The ambient temperature monitoring system is less costly since an interconnection to the pipeline is not required. The ambient temperature sensor may include a programmable controller which is integral with the sensor, as explained subsequently, so that the injection system is tripped on or activated when the ambient temperature falls below 32° F., and is tripped off or deactivated when the ambient temperature rises above 40° F. As with the previously described embodiment, the valve 34 will preferably not be repeatedly cycled opened and closed as the temperature fluctuates around freezing. The selected high and low temperature trip points may be easily set by the user, and may be field adjustable.

In still another embodiment of the invention, the valve 34 will remain closed even though the temperature from the sensors 22 and 24 falls below a preselected low temperature value if the signals from the transducers 26 and 28 indicate that there is no appreciable flow of natural gas through the pipeline 14. If a pipeline valve upstream from the system 10 is closed, the valve 34 will thus remain closed and methanol will not be injected into the pipeline. Methanol will only be injected when natural gas is flowing through the pipeline above a preselected value which could theoretically result in freezing, and the sensed temperature is sufficiently low to indicate the possibility of freezing if methanol is not introduced into the pipeline.

According to another embodiment of the invention, a pressurized gas source 42 is provided for providing a pressurized gas to the injection pump 16 rather than the pipeline fluid. The valve 44 in the line 36 may thus be closed, and the valve 46 in the line 48 opened, so that pressurized gas from the container 42 is available for powering the injection pump 16. As with the embodiments described above, however, the valve 34 will remain closed unless the controller indicates that the valve should open under conditions which represent a possible freezing within the pipeline.

Figure 2:
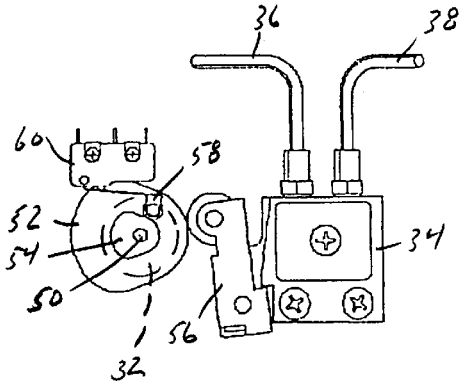
FIG. 2 is a pictorial view illustrating a control motor having rotated a cam for maintaining the control valve in the valve closed position.
Figure 3:
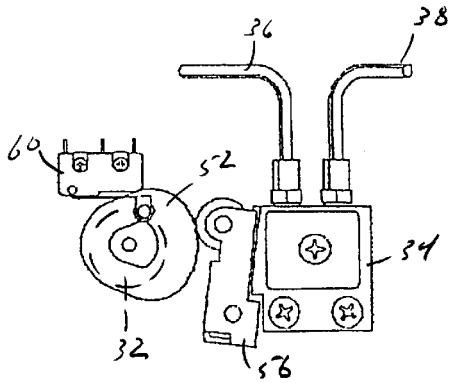
FIG. 3 illustrates the control motor and valve as shown in FIG. 2 in the valve open position.

FIG. 2 generally depicts a DC powered motor 32 for rotating drive shaft 50, which in turn rotates drive cam 52 and sensor cam 54. When an actuation signal is generated by the controller 20, power from the battery 40 is transmitted to actuate motor 32 and thus rotate cams 52 and 54. If the valve 32 is closed, as shown in FIG. 2, the motor 32 may be activated to rotate the cam 52 from a position as shown in FIG. 2 to a position as shown in FIG. 3, so that the control arm 56 is moved to open the valve 34. Once the valve 34 is fully opened, the sensor cam 54 will have rotated to a position so that switch arm 58 is moved to indicate that the valve is now open, and the switch 60 will then send a termination signal to stop further rotation of the shaft 50. Similarly, when the valve 32 is opened as shown in FIG. 3 and the controller 20 sends an actuation signal to close the valve, the motor will be actuated to rotate the cam 52 from the position as shown in FIG. 3 to the position as shown in FIG. 2, thereby closing the valve 34. When the valve 34 is fully closed, the switch 60 will again be activated to sense that the valve is closed, and will terminate power to the valve motor 32.

It is a particular feature of the present invention that very little power is necessary to rotate cam 52 and thus open and close the valve 34. Moreover, when the valve 34 is in either the opened or closed position, no power is required to maintain the valve in that position. A suitable valve 34 according to the present invention is the Model 103 valve available from Aro Fluid Products. A suitable motor is the Model 3440 motor available from Hankscraft Motors Inc. This motor is a gearhead motor with a gear reduced output for the motor shaft resulting from a gear reduction mechanism. The motor utilizes only 4.5 mA of current when powered by a 4.5 V battery, as previously discussed, to achieve its purpose of rotating the cam. Temperature sensors may be solid state digital thermometers and thermostats encapsulated in epoxy for durability and high sensitivity. Model DS 1620 sensors available from Dallas Semiconductor may be used. A single sensor for either probe mounting within the pipeline or chassis mounting for ambient temperature sensing may be employed, so that a single sensor is capable of monitoring either pipeline temperature or ambient temperature, as selected by the system operator. The controller 20 may include a differential pressure switch which is responsive to control the power to the motor 32, and a suitable pressure switch is the Model Q55 switch available from PGI International, Ltd.

DC powered motor 32 for opening and rotating the valve 34 requires significantly less power than that required to operate a conventional solenoid, which in turn may open and close the suitable valve 34. While latching-type solenoids are commercially available which do not require continual power to be supplied to maintain the solenoid in either the opened or the closed position, these latching solenoids are relatively expensive and also require a high energy to actuate the solenoid compared to the motor of the present invention. By utilizing relatively low power to open and close the valve, very low energy is required from the battery 40. Moreover, components for opening and closing the valve are commercially available at a relatively low cost. Because the motor 32 utilizes low power, the system is intrinsically safe and there is little or no likelihood of sparking. Instead of using a cam mechanism to open and close the valve 34, the motor 32 may rotate a quarter-turn valve through a gear mechanism or other conventional mechanical assembly capable of generating a sufficient opening and closing torque for operating the valve with a low power consumption. Accordingly, a low temperature trigger activates the motor 32 to rotate the shaft 50 and open the valve 34 and enable the injection system, while a high temperature trigger similarly activates the motor to further rotate the shaft 50 and close the valve to disable the injection system.

The controller 20, motor 32, valve 34, and battery 40 may be housed within a suitable plastic cabinet 62. Test battery switch 64 may be provided on the front of the cabinet to check the battery voltage level without opening the cabinet. Also, a test system switch 66 may be provided for manually activating the system without regard to the signals from the sensors to cause operation of the injection system for a preselected time period of, for example, 60 seconds, thereby cycling the pump 16 through several cycles while the system operation is being observed by the operator.

The low and high temperature set points may be set utilizing conventional temperature set point units located within the cabinet 62. Alternatively, set points may be provided within each sensor, and may be field programmable by connecting the sensor to the input/output or I/O port of a personal computer with appropriate software. Controller 20 may include appropriate circuitry for automatically opening valve 34 and thus activating the system if the signal from one or more of the sensors is lost. Also, the controller 20 may include circuitry for periodically checking the voltage from the battery 40, and for automatically opening valve 34 any time the tested voltage drops below a preselected value. Accordingly, the injection system will operate to inject methanol if either the signal from the sensor to the controller is interrupted, or if the battery voltage is insufficient to provide reliable system monitoring.

The system 10 of the present invention is particularly well suited for injecting a selected fluid into a pipeline at a remote location where conventional electrical power is not available. Since no power is required to maintain the valve in either the opened or the closed position and little power is required to open or close the valve, the only power normally used by the system is the extremely low power required to operate the sensors. Accordingly, various types of sensors may be used in accordance with the present invention to selectively enable and disable the system so that the injection pump is not unnecessarily operated to inject fluid into the pipeline. Thus the system not only saves costly injection fluid, but also reduces wear on the timer and the injection pump by eliminating cycling under conditions wherein the injection of fluid to the pipeline is not required.

While the techniques of the present invention are particularly well suited for injecting methanol into a natural gas pipeline, the system of the present invention may be used to operate an injection pump which transmits other fluids from a storage tank to the pipeline. Tank 12 may thus contain an odorant which adds a desired smell to the natural gas in order to detect leakage of natural gas from the pipeline. Pipeline 14 may also transmit fluids other than natural gas, such as oil, in which case the injection pump 16 may intermittently pump a rust or corrosion inhibitor from a storage tank 12 into the pipeline. In these latter examples, no particular benefit is served by making the system responsive to temperature, although significant benefits are achieved by providing transducers or another suitable flow meter for discontinuing the injection of fluid to the pipeline when there is little or no flow through the pipeline. The controller 20 may thus be responsive to pulses from a turbine meter or other flow monitoring device, and may terminate injection of the fluid into the pipeline when the monitored flow drops below a selected value. If desired, pulse signals from the pipeline flow monitoring device to the controller may also be used to control the operation of the timer 18, so that the injection pump 16 is cycled less frequently as flow through the pipeline decreases.

Suitable sensors (not shown) may be used for enabling or disabling the system in response to another sensed condition. For example, a sensor within the pipeline may be used to detect the level of odorant in a natural gas pipeline, so that injection pump 16 is cycled to inject additional odorant only when the sensed odorant level in the natural gas pipeline falls below a selected value. Similarly, another sensor may be used for detecting the level of corrosion inhibitors in the fluid in the pipeline, so that additional corrosion inhibitors are added to the pipeline only when the system detects a low level of inhibitors in the pipeline fluid.

The foregoing description of the invention has been directed in primary part to a preferred embodiment in accordance with the requirements of the patent statutes and for purposes of illustration. It will be apparent, however, to those skilled in the art that many further modifications and changes in the specifically described system and method may be made without departing from the scope and spirit of the invention. The invention is therefore not restricted to the preferred embodiments illustrated, and instead includes modifications which may fall within the scope of the following claims.

What is claimed is:

1. A system for injecting an injection fluid into a pipeline at a remote location, the injection fluid being stored within a storage tank at the remote location, the system comprising:

an injection pump for injecting a selected amount of the injection fluid into the pipeline with each pump stroke;

a timer for sequencing stroke initiation of the injection pump at a selected time interval;

a control valve for controlling flow of pressurized fluid to power the injection pump;

a controller for controlling operation of the control valve;

an electric motor responsive to the controller for rotating a motor shaft and a cam rotated by the motor shaft;

a battery for powering the motor and the timer;

a sensor for initiating activation of the motor in response to a sensed pipeline condition; and the control valve operative in response to the rotational position of the cam to control opening and closing of the control valve.

2. The system as defined in claim 1, further comprising:

a switch responsive to rotation of the cam to terminate power to the motor.

3. The system as defined in claim 1, further comprising:

the sensor is a temperature sensor for inputting temperature signals to the controller for enabling activation of the motor and thereby the control valve at a selected temperature and for disabling activation of the motor and thereby the control valve at another selected temperature.

4. The system as defined in claim 1, further comprising:

the sensor is a flow sensor for sensing fluid flow rate through the pipeline and inputting a signal to the controller to close the valve when fluid flow rate drops below a selected value.

5. The system as defined in claim 1, wherein the pipeline transmits natural gas, and the injection fluid is methanol.

6. A system for injecting an injection fluid into a pipeline at a remote location, the injection fluid being stored within a storage tank at the remote location, the system comprising:

an injection pump for injecting a selected amount of the injection fluid into the pipeline with each pump stroke;

a timer for sequencing stroke injection of the injection pump at a selected time interval;

a control valve for controlling flow of pressurized fluid to power the injection pump;

a controller for controlling operation of the control valve;

a motor responsive to the controller for rotating a motor shaft to control opening and closing of the control valve;

a battery for powering the motor and the timer, a cam mounted on the motor shaft and rotatable by the motor from a valve opened position to a valve closed position; and a temperature sensor for inputting temperature signals to the controller for enabling activation of the control valve at a selected temperature and for disabling activation of the control valve at another selected temperature.

7. The system as defined in claim 7, further comprising:

a switch responsive to rotation of the cam to terminate power to the motor.

8. The system as defined in claim 6, further comprising:

a flow sensor for sensing fluid flow rate through the pipeline and inputting a signal to the controller to close the valve when fluid flow rate drops below a selected value.

9. The systems as defined in claim 6, wherein the pipeline transmits natural gas, and the injection fluid is methanol.

10. A method of injecting an injection fluid from a storage tank into a pipeline transmitting a pipeline fluid, comprising:

sensing a condition of the pipeline;

automatically activating a motor in response to the sensed condition to rotate a motor shaft and a cam rotated by the motor shaft;

powering the motor and the timer with a battery;

regulating a control valve in response to rotation of the cam to control flow of pressurized fluid to an injection pump; and automatically cycling the injection pump in response to the timer for injecting a preselected amount of the injection fluid into the pipeline with each pump stroke.

11. The method as defined in claim 10, wherein the injection fluid is methanol, the pipeline fluid is natural gas, and the sensed condition is either the natural gas temperature or the ambient temperature around the pipeline.

12. The method as defined in claim 10, further comprising:

fluidly connecting the pipeline and the injection pump such that the pipeline fluid powers the injection pump.

13. The method as defined in claim 12, further comprising:

sensing the voltage of the battery; and automatically activating the motor to open flow of the injection fluid from the storage tank to the injection pump if the sensed battery voltage drops below a selected value.

14. The method as defined in claim 10, further comprising:

automatically activating the motor to open flow of the injection fluid from the storage tank to the injection pump if a signal indicative of the sensed condition related to the gas in the pipeline is interrupted.

15. The method as defined in claim 10, wherein the sensed condition of the pipeline is fluid flow through the pipeline.

16. The method as defined in claim 10, further comprising:

opening and closing the control valve in response to rotation of the cam to control flow of the selected fluid from the storage tank to the injection pump.

17. The method as defined in claim 16, further comprising:

sensing a rotational position of the cam; and deactivating the motor in response to sensing a certain position of the cam.

18. The system as defined in claim 1, wherein the motor is a gearhead motor including a gear reduction mechanism for rotating the cam in response to the power from the battery.

19. The method as defined in claim 10, further comprising:

selecting a gearhead motor with a gear reduction mechanism for rotating the motor shaft and the cam in response to power from the battery.

* * * * *